US007370685B2

(12) United States Patent
Moriya et al.

(10) Patent No.: US 7,370,685 B2
(45) Date of Patent: May 13, 2008

(54) TAKE UP-TYPE SCREEN DEVICE WHOSE LOCK IS RELEASABLE FROM EITHER INSIDE OR OUTSIDE

(75) Inventors: Hirofumi Moriya, Tokyo (JP); Takashi Moriya, Tokyo (JP)

(73) Assignee: Seiki Sogyo Co., Ltd., Tokyo (JP)

( * ) Notice: Subject to any disclaimer, the term of this patent is extended or adjusted under 35 U.S.C. 154(b) by 267 days.

(21) Appl. No.: 10/515,185

(22) PCT Filed: May 27, 2003

(86) PCT No.: PCT/JP03/06606

§ 371 (c)(1),
(2), (4) Date: Jul. 1, 2005

(87) PCT Pub. No.: WO03/102345

PCT Pub. Date: Dec. 11, 2003

(65) Prior Publication Data

US 2006/0162869 A1 Jul. 27, 2006

(30) Foreign Application Priority Data

May 30, 2002 (JP) ..... 2002-158109

(51) Int. Cl.
*E06B 9/56* (2006.01)

(52) U.S. Cl. ..... 160/290.1; 160/120; 160/31

(58) Field of Classification Search ..... 292/121, 292/122, 123, 97, 100; 160/290.1, 120, 100, 160/99, 28, 27, 31
See application file for complete search history.

(56) References Cited

U.S. PATENT DOCUMENTS 1,972,182 A * 9/1934 Chamberlain, Jr. et al. . 160/276
2,488,794 A * 11/1949 Anderson ..... 292/126
2,710,535 A * 6/1955 Quinn ..... 70/150

(Continued)

FOREIGN PATENT DOCUMENTS

JP 63-19520 5/1988
JP 8-10649 3/1996

OTHER PUBLICATIONS

U.S. Appl. No. 10/515,185, filed Nov. 29, 2004, Moriya, et al.
U.S. Appl. No. 10/515,187, filed Nov. 29, 2004, Moriya, et al.

*Primary Examiner*—David Purol
(74) *Attorney, Agent, or Firm*—Oblon Spivak, McClelland, Maier & Neustadt, P.C.

(57) ABSTRACT

The present invention provides a simple-structured windable screen device provided with a locking element that can be unlocked both from the inside and the outside of a building. According to such a windable screen device, a locking element 7 attached to a movable-frame member 6 includes interior and exterior handle units 19 and 20 respectively attached to an inner side and an outer side of the movable-frame member; a hooking component 23 which is rotatably attached to an attachment plate 21 of the interior handle unit 19 and is engageable with a locking-frame member 3; a spring member 24 which rotatably biases the hooking component 23 in a locking direction; an operating component 25 rotatably attached to an attachment plate 22 of the exterior handle unit 20; and a transmission pin 26 which extends through the movable-frame member 6 in a slidable manner such that the transmission pin 26 transmits a rotation, generated when one of the hooking component 23 and the operating component 25 is pressed, to the other one of the hooking component 23and the operating component 25.

6 Claims, 10 Drawing Sheets

U.S. PATENT DOCUMENTS 3,161,923 A * 12/1964 Crain ..... 292/128
3,893,261 A * 7/1975 Cribben ..... 49/449
4,519,641 A * 5/1985 Fujiya ..... 292/127
5,342,102 A * 8/1994 Takimoto ..... 292/228
5,609,372 A * 3/1997 Ponelle ..... 292/200
6,196,599 B1 * 3/2001 D'Hooge ..... 292/165

* cited by examiner (A)

(B)

(A)

(B)

TAKE UP-TYPE SCREEN DEVICE WHOSE LOCK IS RELEASABLE FROM EITHER INSIDE OR OUTSIDE

TECHNICAL FIELD

The present invention relates to a windable screen device, such as a windable fly-screen door and a windable blind, which is installed in an opening of a building and can allow a screen to be opened and closed by rotating a winding shaft.

BACKGROUND ART

In conventional windable screen devices installed in an opening of a building for insect prevention, light-shielding, or insulation, one end of a screen, such as a fly-screen, is fixed to a movable-frame member, which can be operated to open or close the screen, and the other end of the screen is fixed to a winding shaft provided with a spring which functions as a driving source for winding the screen. Thus, the winding shaft rotates in forward and reverse directions so as to wind and unwind the screen.

In such conventional screen devices, the winding shaft is generally housed in a winding box fixed to one of side-frames disposed along one side of an opening of a building, and a locking-frame member is fixed to the other side-frame disposed along the other side of the opening of the building. Moreover, a locking mechanism is attached to the movable-frame member used for opening and closing the screen. Such a locking mechanism is provided with a hooking component which can be resiliently engaged to an engagement portion provided in the locking-frame member when the screen is pulled out.

However, such conventional windable screen devices have an extremely simple structure and are problematic in that the locking mechanism of the movable-frame member engaged with the locking-frame member can only be unlocked from the inside of the building. For this reason, if a person is outside the building, he/she cannot release the closed state of the screen from the outside. This is problematic in cases where the person might desire to bring in objects through the opening of the building or to simply enter the building through the opening.

Moreover, because the locking mechanism is generally firmly fixed to the movable-frame member in such conventional windable devices, the positional adjustment of the locking mechanism along the movable-frame member is difficult. Performing such an adjustment regardless of its difficulty may result in attachment marks, such as holes and openings, left on the movable-frame member that were used in the previous attachment.

DISCLOSURE OF INVENTION

Accordingly, it is an object of the present invention to provide a simple-structured windable screen device that can be unlocked from both the inside and the outside of a building.

Furthermore, it is another object of the present invention to provide a windable screen device including a locking element that can be unlocked from both the inside and the outside of a building, in which the locking element can be easily adjusted to any position along the movable-frame member without leaving hardly any attachment marks.

Furthermore, it is another object of the present invention to provide a windable screen device provided with a locking mechanism, in which a machining process for, for example, a screw hole for mounting the locking element is not required when the locking element is to be mounted to the movable-frame member or when the locking element is subject to repositioning on the movable-frame member. Specifically, the locking element can simply be mounted to the movable-frame member by providing a small through-hole for inserting a transmission pin at the position where the locking element is to be mounted.

Furthermore, it is another object of the present invention to provide a windable screen device, in which interior and exterior units provided in the locking element can be easily aligned via the transmission pin.

To achieve the above-mentioned objects, the present invention provides a windable screen device which includes a first screen which can be opened and closed along a guide rail; a first movable-frame member which can be operated to open or close the first screen; a locking element attached to the first movable-frame member; and a locking-frame member which engages with the locking element to secure the first movable-frame member when the first screen is pulled out. The locking element includes interior and exterior handle units respectively attached to an inner side and an outer side of the first movable-frame member; a hooking component which is rotatably attached to an attachment plate of one of the interior and exterior handle units and is engageable with an engagement portion provided in the locking-frame member; a spring member which rotatably biases the hooking component in a locking direction; an operating component rotatably attached to an attachment plate of the other one of the interior and exterior handle units; and a transmission pin which extends through the first movable-frame member in a slidable manner such that the transmission pin transmits a rotation, generated when the operating component is pressed, from the operating component to the hooking component so as to disengage the hooking component from the locking-frame member.

Furthermore, according to the windable screen device, the first movable-frame member is preferably uniform in cross-section and includes attachment grooves extending longitudinally along opposite side surfaces of the first movable-frame member, the attachment grooves being T-shaped in cross-section. Moreover, the attachment plates of the interior and exterior handle units are preferably adjustably secured in the attachment grooves via screw-hole-equipped plates disposed in the attachment grooves and screws screwed in screw holes of the screw-hole-equipped plates. Furthermore, the locking-frame member having the engagement portion engageable with the hooking component is preferably formed of a material whose cross-section is uniform.

Furthermore, according to the windable screen device, a first end and a second end of the first screen may respectively be fixed to the first movable-frame member and a first winding shaft provided with a spring functioning as a driving source for winding the first screen, the first winding shaft being housed in a first winding box fixed to a first side-frame disposed along a first side of an opening of a building. Moreover, the locking-frame member may be fixed to a second side-frame disposed along a second side of the opening of the building, such that the first screen can be pulled out in a single-sliding manner.

On the other hand, the windable screen device may further include a second screen which can be opened and closed along the guide rail. In this case, the locking-frame member preferably includes a second movable-frame member provided with an engagement portion engageable with the hooking component, the second movable-frame member being attached to a first end of the second screen such that the first screen and the second screen are capable of being pulled out in a double-sliding manner. Moreover, a second end of the second screen is preferably fixed to a second winding shaft provided with a spring functioning as a driving source for winding the second screen, the second winding shaft being housed in a second winding box fixed to the second side-frame disposed along the second side of the opening of the building.

Furthermore, according to the windable screen device, the second movable-frame member preferably includes attachment grooves extending longitudinally along opposite side surfaces of the second movable-frame member, the attachment grooves being T-shaped in cross-section. In this case, handle portions are preferably adjustably secured in the attachment grooves of the second movable-frame member via screw-hole-equipped plates partially disposed in the attachment grooves and screws screwed in screw holes of the screw-hole-equipped plates. Moreover, a wall segment of one of the attachment grooves of the second movable-frame member preferably defines the engagement portion engageable with the hooking component.

According to the windable screen device of the present invention, the interior and exterior handle units of the locking element are respectively attached to the inner and outer sides of the movable-frame member in a manner such that the interior handle unit and the exterior handle unit face each other. Moreover, the hooking component is rotatably attached to the attachment plate of one of the interior and exterior handle units, and is rotatably biased in the locking direction by the spring member. Thus, when the movable-frame member is moved in the direction for pulling out the screen and becomes overlapped with the locking-frame member, the hooking component of the movable-frame member automatically engages with the engagement portion of the locking-frame member. Accordingly, this maintains a state where the screen is pulled out.

Furthermore, the hooking component and the operating component are rotatably attached to the corresponding interior and exterior handle units. Because the transmission pin slidably extending through the movable-frame member transmits a rotation, generated when one of the hooking component and the operating component is pressed, to the other one of the hooking component and the operating component, the hooking component or the operating component can be operated from both the inside and the outside of a building. Moreover, when the hooking component or the operating component is operated from the inside or the outside of a building in order to rotate the hooking component in the unlocking direction against the biasing force of the spring member, the hooking component becomes disengaged from the engagement portion of the locking-frame member.

Furthermore, since such disengagement of the locking element can be performed by operating the hooking component or the operating component to rotate the hooking component in the unlocking direction against the biasing force of the spring member, the locking element achieves a high locking function while having a simple structure.

Furthermore, according to the windable screen device, the screw-hole-equipped plates are disposed in the T-shaped attachment grooves in cross-section, which extend longitudinally along the opposite side surfaces of the movable-frame member. The screws screwed in the screw holes of the screw-hole-equipped plates allow the attachment plates of the interior and exterior handle units to be secured in the attachment grooves in an adjustable manner such that the interior and exterior handle units can be adjustably positioned along the attachment grooves or can easily be repositioned. Such repositioning of the interior and exterior handle units can easily be performed by simply forming a new small through-hole for the transmission pin at the position where the interior and exterior handle units are to be disposed. This means that a machining process for, for example, a screw hole for mounting the locking element is not required, and moreover, only leaves the previous small through-hole in the attachment grooves, which was used before the repositioning of the handle units. If only a slight positional change is made, the previous small through-hole can be hidden with the locking element. Furthermore, providing such a through-hole for the transmission pin is advantageous in that the interior and exterior handle units of the locking element can be easily aligned with each other.

BEST MODE FOR CARRYING OUT THE INVENTION

Embodiments of the present invention will now be described with reference to the drawings. FIGS. 1 to 5 illustrate a first embodiment in which a windable screen device according to the present invention is applied to a side-sliding fly-screen door.

Figure 1:
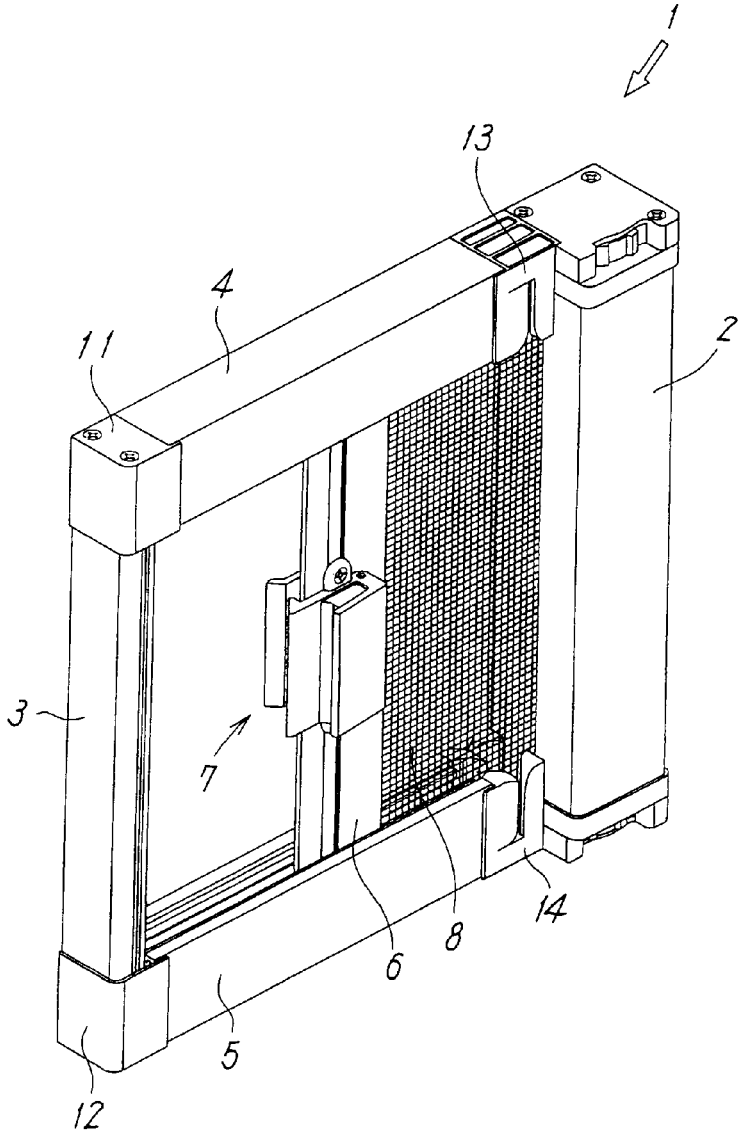
FIG. 1 is a perspective view of a windable screen device according to a first embodiment of the present invention.
Figure 2:
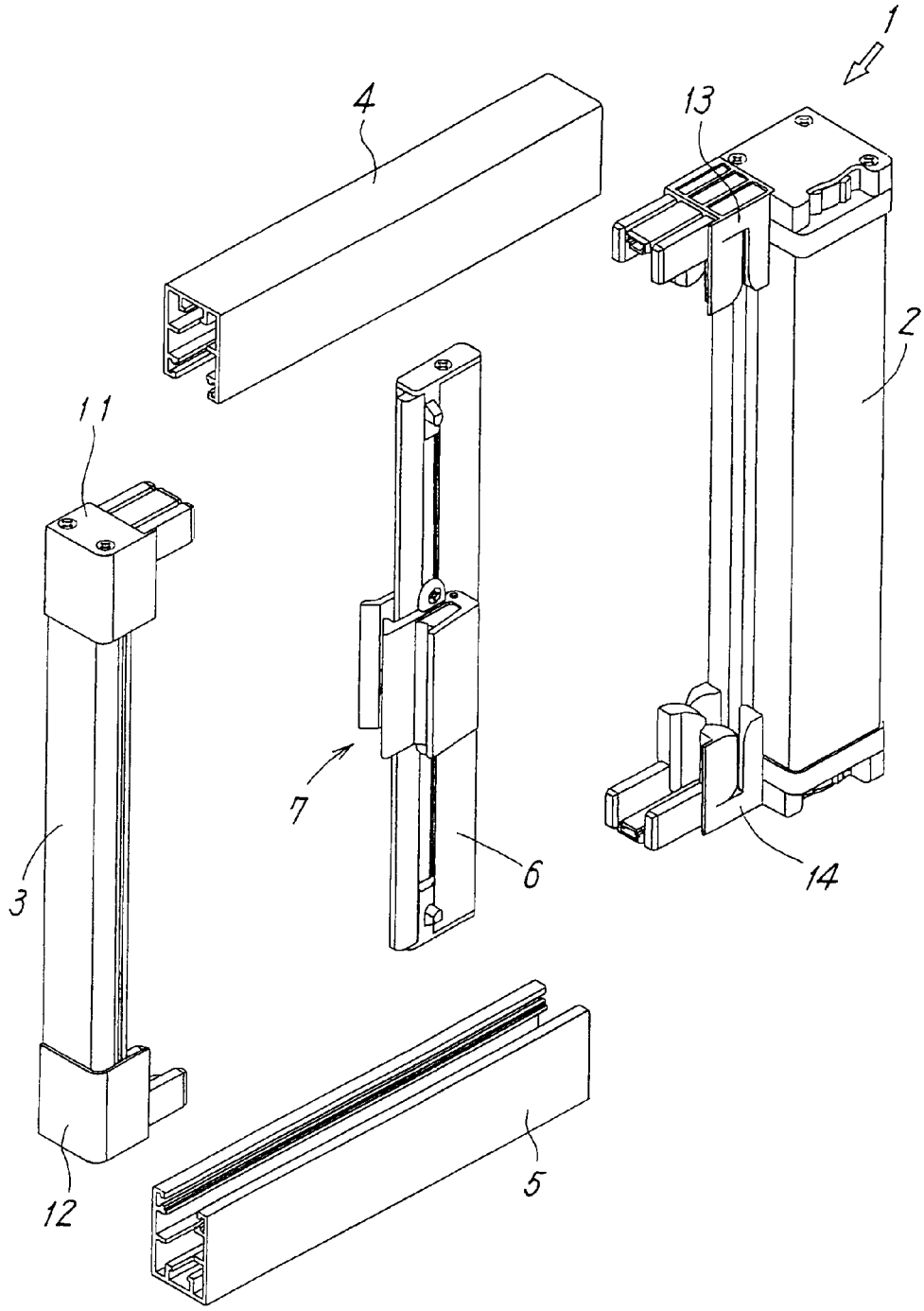
FIG. 2 is an exploded perspective view of the windable screen device of FIG. 1.
Figure 3:
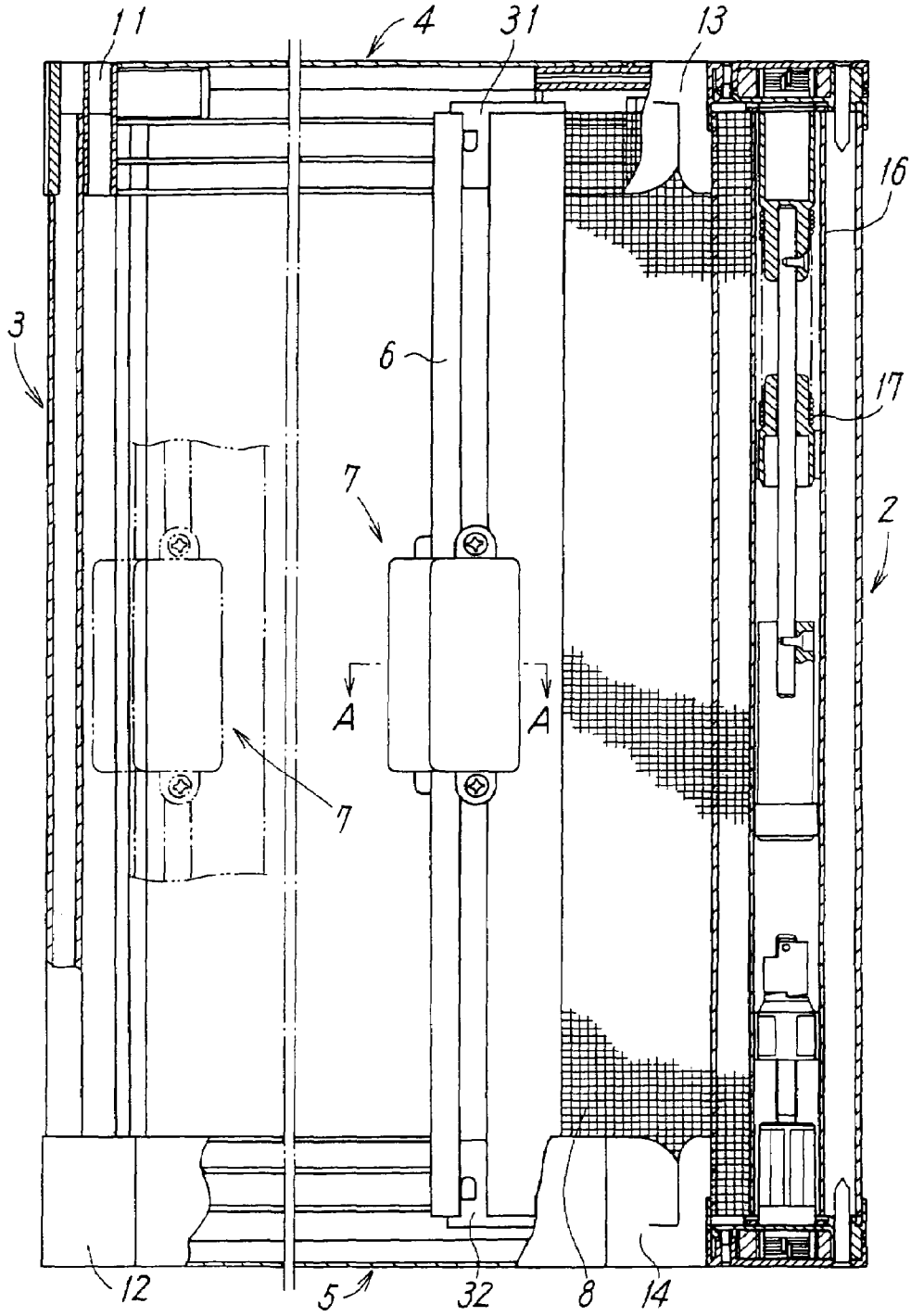
FIG. 3 illustrates a front view and a partial cross-sectional view of the windable screen device of FIG. 1.

Referring to FIGS. 1 and 2, a fly-screen door 1 includes a winding box 2 fixed to one of side-frames (not shown in the drawings) disposed along one side of an opening of a building; a stationary locking-frame member 3 fixed to the other side-frame (not shown in the drawings) disposed along the other side of the opening of the building; upper and lower guide rails 4 and 5 respectively mounted to upper and lower frames disposed along the upper and lower sides of the opening of the building; a screen 8, i.e. a fly-screen, which can be opened and closed by being moved along the upper and lower guide rails 4 and 5; a movable-frame member 6 whose one side is fixed to the screen 8 and which can be operated so as to open or close the screen 8; a locking element 7 fixed to the movable-frame member 6; corner joints 11 and 12 for joining the locking-frame member 3 with the upper and lower guide rails 4 and 5; and corner joints 13 and 14 for joining the winding box 2 with the upper and lower guide rails 4 and 5.

Figure 4:
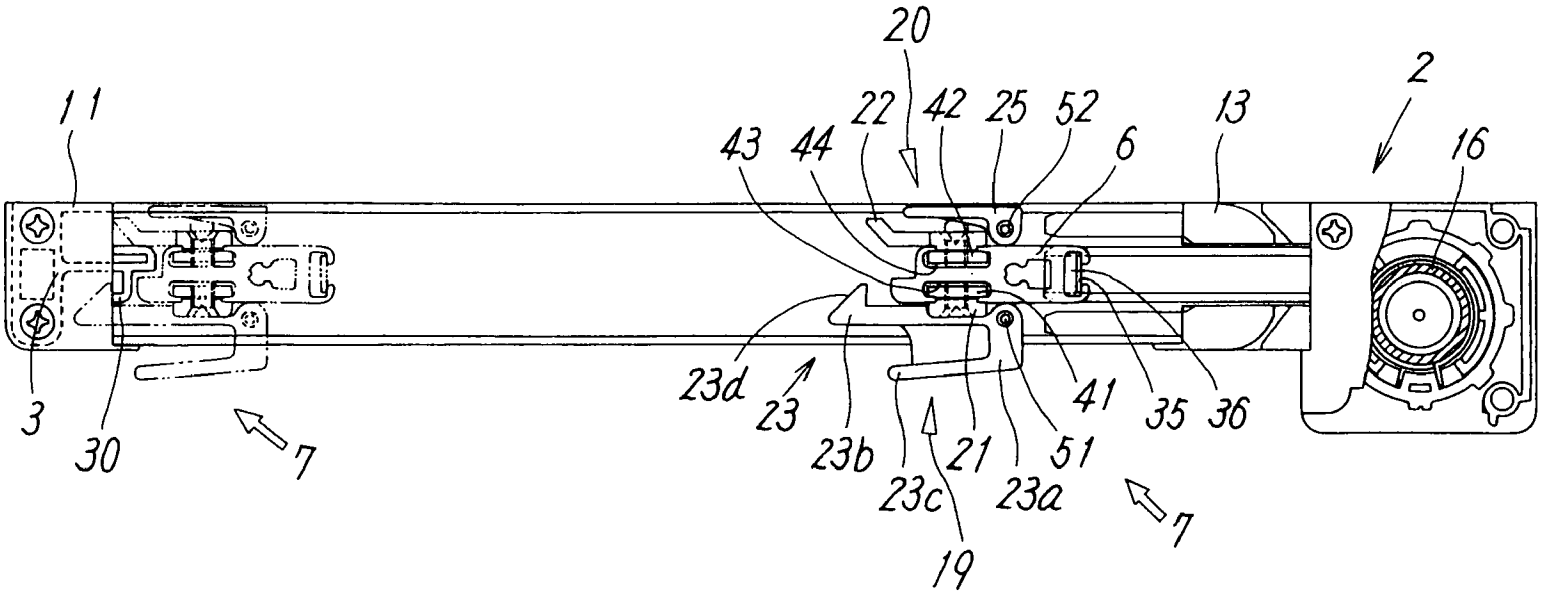
FIG. 4 illustrates a plan view and a partial cross-sectional view of the windable screen device of FIG. 1.
Figure 5:
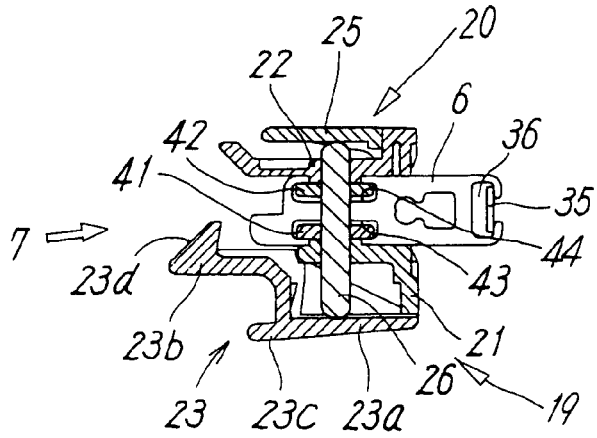
FIG. 5 is a cross-sectional view taken along line A-A in FIG. 3.

In detail, referring to FIGS. 4 and 5, the movable-frame member 6 is formed of, for example, an extruded material having a long-plate structure such that its cross-section is uniform. The extruded material may be, for example, aluminum or synthetic resin. Furthermore, the movable-frame member 6 has an attachment groove 36 which is substantially T-shaped in cross-section and extends longitudinally along one side surface of the movable-frame member 6. The attachment groove 36 holds therein a screen-securing plate 35 to which one end of the screen 8 is attached, such that the screen 8 is secured. Furthermore, referring to FIG. 3, the other end of the screen 8 is secured to a winding shaft 16 which is provided with a spring 17 acting as a driving source for winding the screen 8. The winding shaft 16 is housed in the winding box 2. On the other hand, referring to FIGS. 2 and 3, the upper and lower ends of the movable-frame member 6 are respectively provided with caps 31 and 32. The caps 31 and 32 are slidable on rail components disposed on inner sides of the upper and lower guide rails 4 and 5, such that the rail components face each other.

Figure 7:
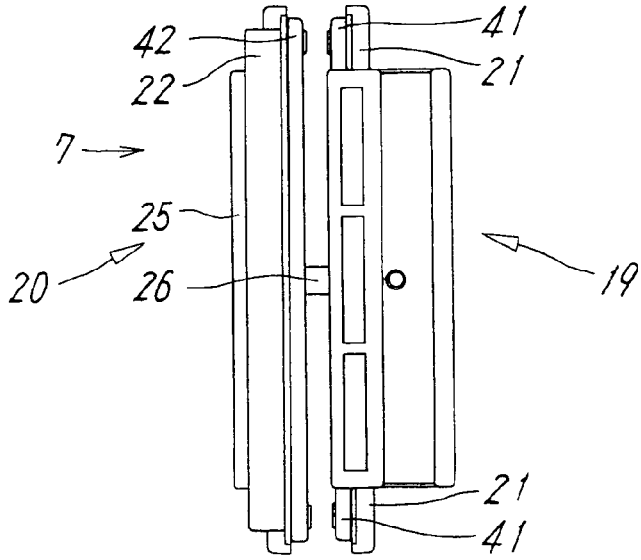
FIG. 7 is a side view of the locking element shown in FIG. 6.

Referring to FIGS. 4 and 5, the movable-frame member 6 is further provided with attachment grooves 43 and 44 which are T-shaped in cross-section and extend respectively along two opposite sides of the movable-frame member 6 in the longitudinal direction of the movable-frame member 6. Moreover, the attachment grooves 43 and 44 are used for securing the locking element 7, which will be described below in detail. Referring to FIGS. 4, 5, and 7, the attachment grooves 43 and 44 are respectively engaged with screw-hole-equipped plates 41 and 42 which are rectangular in cross-section and have an elongated structure. Each of the screw-hole-equipped plates 41 and 42 is provided with screw holes on its two opposite ends, and each of screws 45 to 48 (shown in FIGS. 8 and 9) for securing the locking element 7 is screwed in the corresponding one of the screw holes. Moreover, the central portion of each of the screw-hole-equipped plates 41 and 42 is provided with a hole through which a transmission pin 26 extends.

The screw-hole-equipped plates 41 and 42 do not necessarily need to have an elongated-plate structure. Alternatively, the screw-hole-equipped plates may have a short-plate-like structure such that each of the plates is engaged with the corresponding one of the attachment grooves 43 and 44 at a position where the corresponding screw can be screwed.

Figure 8:
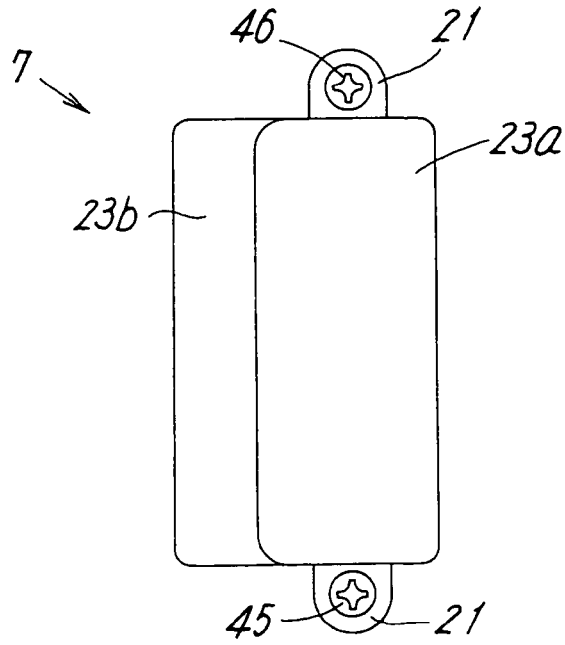
FIG. 8 is a front view of the locking element shown in FIG. 6.
Figure 9:
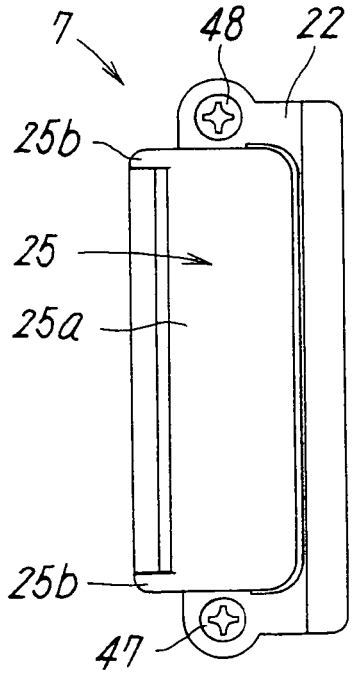
FIG. 9 is a rear view of the locking element shown in FIG. 6.
Figure 10:
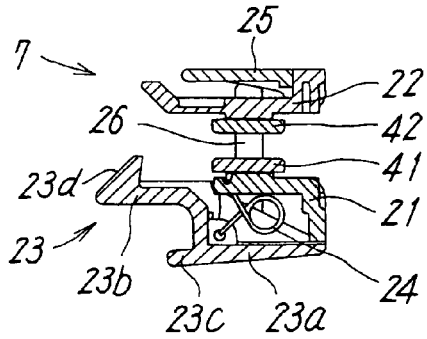
FIG. 10 is a cross-sectional view of the locking element shown in FIG. 6 taken along a plane in which a spring member can be seen.

FIGS. 6 to 10, respectively, are a plan view, a side view, a front view, a rear view, and a cross-sectional view of the locking element 7. In detail, the cross-sectional view of FIG. 10 is taken along a plane in which a spring member 24 can be seen.

Referring to FIGS. 4 to 6 and FIG. 10, the locking element 7 includes an interior handle unit 19 and an exterior handle unit 20 which are respectively attached to the inner and outer sides of the movable-frame member 6 in a manner such that the interior handle unit 19 and the exterior handle unit 20 face each other. The handle units 19 and 20 include a hooking component 23 which is rotatably attached to an attachment plate 21 provided in the interior handle unit 19 and is engageable with an engagement portion 30 (see FIG. (11B)) provided in the locking-frame member 3; the spring member 24 (FIG. 10) which rotatably biases the hooking component 23 in the locking direction; an operating component 25 which is rotatably attached to an attachment plate 22 provided in the exterior handle unit 20 while facing the hooking component 23; and the transmission pin 26 extending through a small hole provided in the movable-frame member 6. The transmission pin 26 is slidable in the small hole such that one of the hooking component 23 and the operating component 25 receives a rotational force via the sliding transmission pin 26 when the other one of the hooking component 23 and the operating component 25 is pressed.

Referring to FIGS. 5 and 8, the attachment plate 21 of the interior handle unit 19 is substantially L-shaped in cross-section and has flat-plate attachment segments projected at the opposite ends of the attachment plate 21. The central portion of the attachment plate 21 is provided with a hole through which the transmission pin 26 extends. The attachment segments are provided with through-holes through which the corresponding screws 45 and 46 screwed in the screw holes of the screw-hole-equipped plate 41 extend.

By screwing the screws 45 and 46 into the corresponding screw holes in the screw-hole-equipped plate 41, the attachment plate 21 of the interior handle unit 19 can be secured to the attachment groove 43 in a positionally-adjustable manner such that wall segments of the T-shaped attachment groove 43 in cross-section are sandwiched between the attachment plate 21 and the screw-hole-equipped plate 41. For this reason, the movable-frame member 6 does not require additional machining, such as forming screw holes where the attachment plate 21 is to be attached.

The hooking component 23 includes a plate-like main body 23*a* which is L-shaped in cross-section and whose longitudinal ends are closed; a hook portion 23*b* which extends substantially perpendicularly from one of the sides of the substantially L-shaped main body 23*a*; and a handle portion 23*c*.

Figure 6:
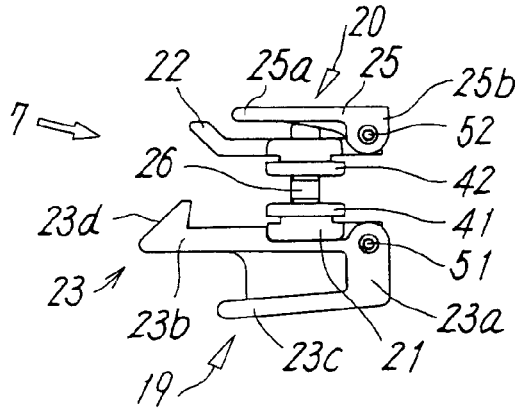
FIG. 6 is a plan view of a locking element provided in the windable screen device of FIG. 1.

Referring to FIG. 6, the main body 23*a* is rotatably attached to the attachment plate 21 via a hinge 51. The walls of the substantially L-shaped main body 23*a* in cross-section and the walls of the substantially L-shaped attachment plate 21 in cross-section form a substantially box-like structure. An internal space defined by such a substantially box-like structure accommodates the spring member 24 used for rotatably biasing the hooking component 23 in the locking direction. The inner surface of one of the walls of the main body 23*a* is in contact with the transmission pin 26.

The front end of the hook portion 23*b* is bent so as to form a hook. Moreover, the front end is provided with an inclined surface 23*d* which allows the hook portion 23*b* to be lifted against the biasing force of the spring member 24 when the inclined surface 23*d* comes into contact with the engagement portion 30 of the locking-frame member 3. This automatically forces the hook portion 23*b* to become engaged with the engagement portion 30. Furthermore, the handle portion 23*c* is projected from the main body 23*a* to an extent such that the hooking component 23 can be easily lifted.

Referring to FIGS. 5 and 9, the attachment plate 22 of the exterior handle unit 20 has a substantially-depressed plate structure in cross-section, in which the front portion of the attachment plate 22 is provided with an inclined segment functioning as a hook guide, and the base portion is provided with a side wall. The central portion of the attachment plate 22 is provided with a hole through which the transmission pin 26 extends. The two longitudinal end portions of the attachment plate 22 are provided with through-holes through which the corresponding screws 47 and 48 screwed in the screw holes of the screw-hole-equipped plate 42 extend.

By inserting the screws 47 and 48 through the corresponding through-holes and screwing them into the corresponding screw holes of the screw-hole-equipped plate 42, the attachment plate 22 of the exterior handle unit 20 can be secured to the attachment groove 44 in a positionally-adjustable manner such that wall segments of the T-shaped attachment groove 44 in cross-section are sandwiched between the attachment plate 22 and the screw-hole-equipped plate 42.

Referring to FIGS. 6 and 9, the operating component 25 includes a plate-like main body 25*a*, and attachment segments 25*b* protruding perpendicularly from two longitudinal ends of the main body 25*a*. The inner surface of the main body 25*a* is in contact with the transmission pin 26. The attachment segments 25*b* are provided with a hinge 52 via which the operating component 25 is rotatably attached to the side wall of the attachment plate 22 of the exterior handle unit 20.

Figure 11:
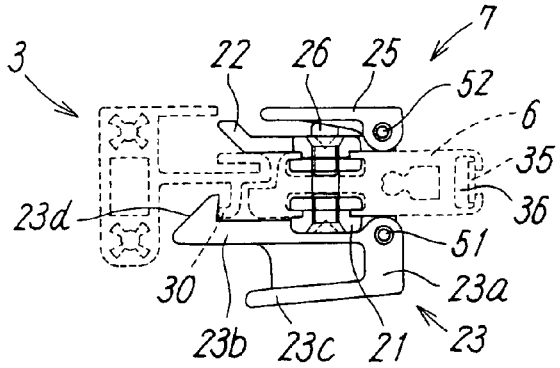
FIG. 11 includes plan view (A) illustrating a state where the locking element according to the first embodiment is locked to a stationary locking-frame member; and plan view (B) illustrating a state where the locking element is unlocked from the locking-frame member.
Figure 11:
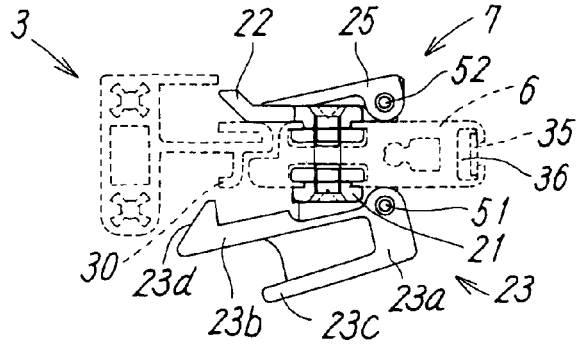

FIGS. 11(A) and 11(B) illustrate the first embodiment in which the locking element 7 is provided in a windable single-sliding-screen device. Specifically, FIGS. 11(*a*) (A) and 11(B) respectively illustrate a state where the locking element 7 is locked to the locking-frame member 3, and the locking element 7 is unlocked from the locking-frame member 3. The locking-frame member 3 provided with the engagement portion 30 is formed of, for example, aluminum or synthetic resin and is, for example, an extruded material whose cross-section is uniform.

When the movable-frame member 6 is moved in the direction for pulling out the screen 8, the hook portion 23*b* of the hooking component 23 attached to the movable-frame member 6 comes into contact with the engagement portion 30 of the locking-frame member 3. Then, the inclined surface 23*d* allows the hook portion 23*b* to receive a component force in a direction opposite to the locking direction. Thus, while overcoming the biasing force of the spring member 24, the hook portion 23*b* moves over the engagement portion 30. When the movable-frame member 6 reaches a position where the movable-frame member 6 and the locking-frame member 3 overlap with each other, the hooking component 23 of the movable-frame member 6 automatically engages with the engagement portion 30 of the locking-frame member 3 so as to achieve a locked state shown in FIG. 11(A). Accordingly, the screen is pulled out in a single-sliding manner.

Such a locked state can be released both from the inside and the outside of a building. To release the locked state from the inside, the hooking component 23 may be rotated against the biasing force of the spring member 24 in the unlocking direction (i.e. toward the interior of the building) so that the hook portion 23*b* can be disengaged from the engagement portion 30 of the locking-frame member 3. Consequently, the movable-frame member 6 can be moved away from the locking-frame member 3.

On the other hand, referring to FIG. 11 (B), in order to release the locked state from the outside, the operating component 25 disposed on the outer side of the movable-frame member 6 may be pressed toward the interior of the building so as to rotate the operating component 25 in the unlocking direction (i.e. toward the interior of the building). In this case, since the rotation of the operating component 25 is transmitted to the hooking component 23 via the transmission pin 26, the hooking component 23 is rotated against the biasing force of the spring member 24 in the unlocking direction (i.e. toward the interior of the building). Thus, the hook portion 23*b* becomes disengaged from the engagement portion of the locking-frame member 3.

When the pressing force against the operating component 25 is removed, the biasing force of the spring member 24 allows the hooking component 23 to rotate in the locking direction. Accordingly, the rotation of the hooking component 23 is transmitted to the operating component 25 via the transmission pin 26, and thus allows the operating component 25 to return to its original position.

Figure 12:
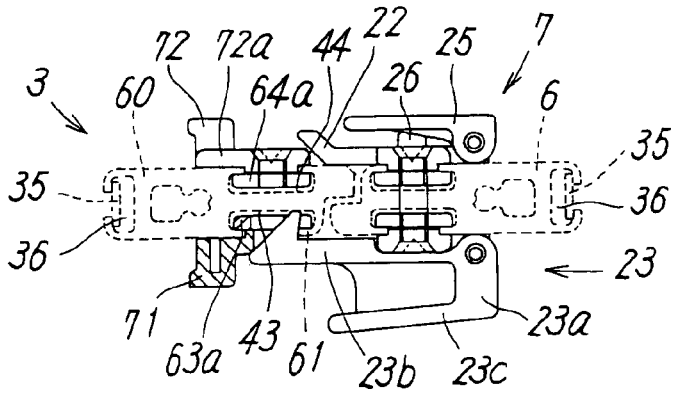
FIG. 12 illustrates the operation of a locking element provided in a windable double-sliding-screen device according to a second embodiment, and includes plan view (A) illustrating a state where the locking element is locked to a second movable-frame member; and plan view (B) illustrating a state where the locking element is unlocked from the second movable-frame member.
Figure 12:
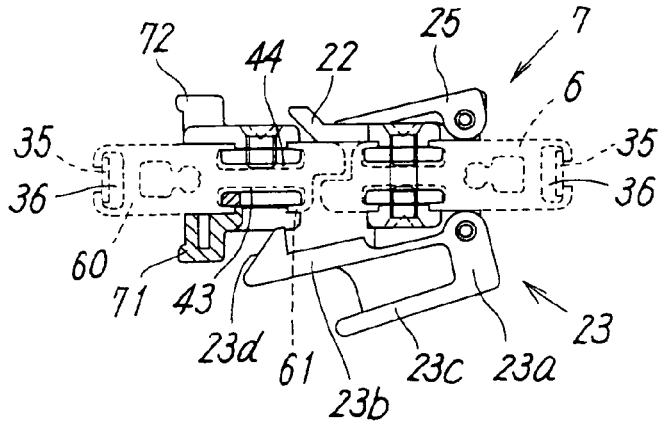
Figure 13:
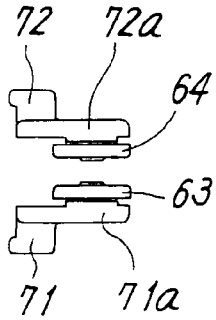
FIG. 13 is a plan view of a pair of handle portions disposed on the second movable-frame member shown in FIG. 12 such that the handle portions face each other.
Figure 14:
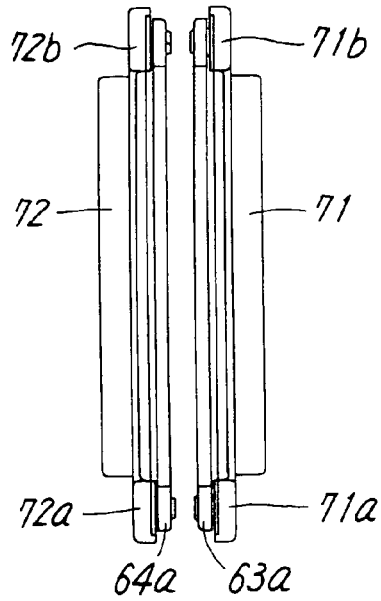
FIG. 14 is a side view of the handle portions shown in FIG. 13.
Figure 15:
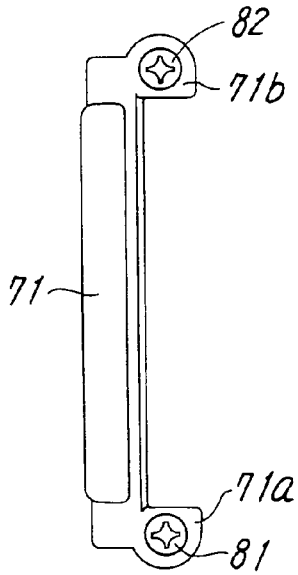
FIG. 15 is a front view showing one of the handle portions shown in FIG. 13.
Figure 16:
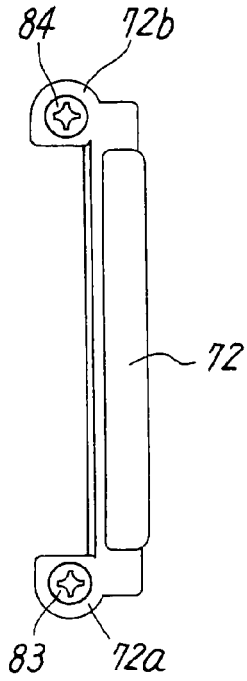
FIG. 16 is a rear view showing the other handle portion shown in FIG. 13.

FIGS. 12(A) and 12(B) illustrate a second embodiment in which the locking element 7 is provided in a windable double-sliding-screen device.

Although the locking-frame member 3 is fixed to an opening of a building in the single-sliding screen device described above, the double-sliding screen device of the second embodiment is provided with a second movable-frame member 60 in place of the stationary locking-frame member 3, such that the movable-frame member 60 functions as a movable locking-frame member. In this case, the hooking component 23 of the movable-frame member 6 is engageable with an engagement portion 61 provided in the second movable-frame member 60.

Like the movable-frame member 6, the second movable-frame member 60 has a long-plate structure provided with the attachment grooves 36, 43, and 44 which are T-shaped in cross-section. Although the second movable-frame member 60 basically has the same structure as the movable-frame member 6, the second movable-frame member 60 is slightly different from the movable-frame member 6 in that a segment of the attachment groove 43 defines the engagement portion 61 engageable with the hooking component 23 of the movable-frame member 6, and that a pair of handle portions 71 and 72 is respectively attached to the attachment grooves 43 and 44.

In detail, referring to FIGS. 13 to 16, the handle portions 71 and 72 disposed on the movable-frame member 60 face each other and have the same shape. The two opposite ends of the handle portion 71 are respectively provided with attachment segments 71*a* and 71*b*. The attachment segments 71*a* and 71*b* are provided with through-holes respectively for screws 81 and 82. Similarly, the two opposite ends of the handle portion 72 are respectively provided with attachment segments 72*a* and 72*b*. The attachment segments 72*a* and 72*b* are similarly provided with through-holes respectively for screws 83 and 84. The T-shaped attachment groove 43 in cross-section provided in the movable-frame member 60 holds therein screw-hole-equipped plates 63*a* and 63*b*, and the T-shaped attachment groove 44 in cross-section provided in the movable-frame member 60 holds therein screw-hole-equipped plates 64*a* and 64*b*. The handle portion 71 is secured to the attachment groove 43 in a positionally-adjustable manner such that wall segments of the attachment groove 43 are sandwiched between the attachment segment

71*a* and the screw-hole-equipped plate 63*a* and between the attachment segment 71*b* and the screw-hole-equipped plate 63*b*. Similarly, the handle portion 72 is secured to the attachment groove 44 in a positionally-adjustable manner such that wall segments of the attachment groove 44 are sandwiched between the attachment segment 72*a* and the screw-hole-equipped plate 64*a* and between the attachment segment 72*b* and the screw-hole-equipped plate 64*b*.

Referring to FIGS. 12(A) and 12(B), the space provided in the attachment groove 43 between the two screw-hole-equipped plates 63*a* and 63*b* functions as a space into which the hook portion 23*b* of the hooking component 23 can be inserted. Moreover, one of the wall segments of the attachment groove 43 defines the engagement portion 61 which is engageable with the hook portion 23*b*.

On the other hand, the attachment groove 36 holds therein the screen-securing plate 35 to which one end of a second screen (not shown in the drawings) is attached. The second screen can be opened and closed along the upper and lower guide rails 4 and 5.

The other end of the second screen is secured to a second winding shaft which is provided with a spring acting as a driving source for winding the second screen. The second winding shaft is housed in a second winding box which is disposed along a side-frame of an opening of a building.

The structures of the second movable-frame member 60, the second screen which can be pulled out with the second movable-frame member 60, and the second winding box housing therein the second winding shaft for winding the second screen, for example, are similar to the structures of the corresponding elements in the windable single-sliding-screen device described previously, and therefore, drawings and descriptions of such elements will be omitted.

In the windable double-sliding-screen device, when the movable-frame members 6 and 60 are moved in the corresponding directions for pulling out the screens, the hook portion 23*b* of the hooking component 23 attached to the movable-frame member 6 comes into contact with the engagement portion 61 of the movable-frame member 60. Then, the hook portion 23*b* having the inclined surface on its front end receives a component force in a direction opposite to the locking direction. Thus, while overcoming the biasing force of the spring member 24, the hook portion 23*b* moves over the engagement portion 61. When the movable-frame member 6 reaches a position where the movable-frame member 6 and the movable-frame member 60 overlap with each other, the hooking component 23 of the movable-frame member 6 automatically engages with the engagement portion 61 of the movable-frame member 60 so as to achieve a locked state shown in FIG. 12(A). Accordingly, the screens are pulled out in a double-sliding manner.

Referring to FIG. 12(B), such a locked state can be released both from the inside and the outside of a building. Specifically, to release the locked state from the inside, the hooking component 23 may be rotated against the biasing force of the spring member 24 in the unlocking direction (i.e. toward the interior of the building). On the other hand, in order to release the locked state from the outside, the operating component 25 may be pressed toward the interior of the building from the outside so as to rotate the hooking component 23 against the biasing force of the spring member 24 in the unlocking direction (i.e. toward the interior of the building) via the transmission pin 26.

The operation for releasing the locked state is the same as that in the first embodiment illustrated in FIG. 11, and therefore, detailed description of such an operation will be omitted.

According to the second embodiment illustrated in FIGS. 12 to 16, the second movable-frame member 60 having basically the same structure as the movable-frame member 6 functions as a locking-frame member to which the hooking component 23 provided in the movable-frame member 6 can be locked. Moreover, a segment of the attachment groove 43, in which the handle portion 71 of the movable-frame member 60 is disposed, defines the engagement portion 61. Accordingly, a simple-structured windable double-sliding-screen device that can be unlocked both from the inside and the outside of a building can be provided at low cost.

Furthermore, the present invention is not limited to the above embodiments. For example, although the winding shaft for the screen is housed in a winding box fixed to a side-frame disposed along one side of an opening of a building according to the above embodiments, the winding shaft for the screen may alternatively be housed in a movable winding box provided in the movable-frame member.

Furthermore, according to the locking element 7 in the above embodiments, the hooking component 23 is attached to the attachment plate 21 of the interior handle unit 19, and the operating component 25 is attached to the attachment plate 22 of the exterior handle unit 20. However, the present invention is not limited to such a structure of the above embodiments. For example, the interior handle unit 19 and the exterior handle unit 20 may alternatively be disposed in an opposite manner such that the hooking component is attached to the attachment plate of the exterior handle unit, and the operating component is attached to the attachment plate of the interior handle unit.

According to the present invention described above, a simple-structured windable screen device that can be unlocked both from the inside and the outside of a building is provided.

The invention claimed is:

1. A windable screen device which can be unlocked from an inner side and an outer side of the device, the windable screen device comprising (a) a first screen which can be opened and closed along a guide rail;

(b) a first movable-frame member which can be operated to open or close the first screen;

(c) a locking element attached to the first movable-frame member; and (d) a locking-frame member which engages with the locking element to secure the first movable-frame member when the first screen is pulled out, wherein (e) the locking element includes (i) interior and exterior handle units respectively attached to an inner side and an outer side of the first movable-frame member;

(ii) a hooking component which is rotatably attached to an attachment plate of one of the interior and exterior handle units and is engageable with an engagement portion provided in the locking-frame member;

(iii) a spring member which rotatably biases the hooking component in a locking direction;

(iv) an operating component rotatably attached to an attachment plate of the other one of the interior and exterior handle units; and (v) a transmission pin which extends through the first movable-frame member in a slidable manner such that the transmission pin transmits a rotation, generated when the operating component is pressed, from the operating component to the hooking component so as to disengage the hooking component from the locking-frame member (f) the interior handle unit and the exterior handle unit are respectively attached to the inner and outer sides of the first movable-frame member by attachment plates which extend in the opening and closing direction of the first screen in a manner such that the interior handle unit and the exterior handle unit face each other; and (g) the transmission pin pierces the first movable-frame member at a right angle with the opening and closing direction of the first screen.

2. The windable screen device according to claim 1, wherein (a) the first movable-frame member is uniform in cross-section and includes attachment grooves which are T-shaped in cross-section and which extend longitudinally along opposite side surfaces of the first movable-frame member, the attachment grooves being T-shaped in cross-section, (b) the attachment plates of the interior and exterior handle units are adjustably secured in the attachment grooves via screw-hole-equipped plates disposed in the attachment grooves and screws screwed in screw holes of the screw-hole-equipped plates (c) the attachment grooves are attached to the inner and outer sides of the movable-frame member opposite to each other.

3. The windable screen device according to claim 1, wherein (a) the locking-frame member having an engagement portion engageable with the hooking component and (b) the locking frame member is formed of a material whose cross-section is uniform.

4. The windable screen device according to claim 1, wherein (a) a first end and a second end of the first screen are respectively fixed to the first movable-frame member and a first winding shaft provided with a spring functioning as a driving source for winding the first screen, the first winding shaft being housed in a first winding box fixed to a first side-frame configured to be disposed along a first side of an opening of a building, and (b) the locking-frame member is fixed to a second side-frame configured to be disposed along a second side of the opening of the building, such that the first screen can be pulled out in a single-sliding manner.

5. The windable screen device according claim 1, further comprising (a) a second screen which can be opened and closed along the guide rail, wherein (b) the locking-frame member comprises a second movable-frame member provided with an engagement portion engageable with the hooking component, (c) the second movable-frame member is attached to a first end of the second screen, (d) the first screen and the second screen are capable of being pulled out in a double-sliding manner, (e) a second end of the second screen is fixed to a second winding shaft provided with a spring functioning as a driving source for winding the second screen, and (f) the second winding shaft is housed in a second winding box fixed to the second side-frame and configured to be disposed along the second side of the opening of the building.

6. The windable screen device according to claim 5, wherein (a) the second movable-frame member includes attachment grooves extending longitudinally along opposite side surfaces of the second movable-frame member, (b) the attachment grooves in the second movable-from member are T-shaped in cross-section, (c) handle portions are adjustably secured in the attachment grooves of the second movable-frame member via screw-hole-equipped plates partially disposed in the attachment grooves and screws screwed in screw holes of the screw-hole-equipped plates, and (d) a wall segment of one of the attachment grooves of the second movable-frame member defines the engagement portion engageable with the hooking component.

* * * * *

UNITED STATES PATENT AND TRADEMARK OFFICE

CERTIFICATE OF CORRECTION

PATENT NO. : 7,370,685 B2
APPLICATION NO. : 10/515185
DATED : May 13, 2008
INVENTOR(S) : Moriya et al.

It is certified that error appears in the above-identified patent and that said Letters Patent is hereby corrected as shown below:

On the title page, Item (54), and Column 1, and the title information is incorrect. Item (54) and Column 1 should read:

-- (54) WINDABLE SCREEN DEVICE UNLOCKABLE FROM INNER AND OUTER SIDES OF THE DEVICE --

Signed and Sealed this

Fourteenth Day of October, 2008

JON W. DUDAS
*Director of the United States Patent and Trademark Office*